US006112487A

United States Patent [19]

Shaw et al.

[11] Patent Number: 6,112,487

[45] **Date of Patent: *Sep. 5, 2000**

[54] DECORATIVE WALL AND METHOD OF FABRICATION

[76] Inventors: Lee A. Shaw, 1924 Irvine Ave., Newport Beach, Calif. 92660; Ronald D. Shaw, 1988 Pelican, Costa Mesa, Calif. 92626

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 09/156,985

[22] Filed: Sep. 18, 1998

Related U.S. Application Data

[63] Continuation of application No. 08/906,286, Aug. 4, 1997, Pat. No. 5,887,399.

[51] Int. Cl.[7] ..... E04B 1/16

[52] U.S. Cl. ..... 52/311.1; 52/315; 52/318; 52/612; 52/742.13; 264/34

[58] Field of Search ..... 52/311.1, 311.2, 52/315, 318, 612, 741.13, 741.14, 742.14, 745.09; 264/31, 33, 34; 256/19; 249/18, 33–35

[56] References Cited

U.S. PATENT DOCUMENTS 348,443 8/1886 Anderson .
745,068 11/1903 Menczarski .
958,194 5/1910 Thomas .
1,397,678 11/1921 De Paoli .
1,534,353 4/1925 Besser .
2,101,540 12/1937 Gullich .
3,874,140 4/1975 Seehusen .
5,887,399 3/1999 Shaw et al. ..... 52/311.1

*Primary Examiner*—Robert Canfield
*Attorney, Agent, or Firm*—Stetina Brunda Garred & Brucker

[57] ABSTRACT

A constructed wall structure and method of fabrication that replicates a wall formed by nature. The structure has a plurality of discrete layers, with each layer constructed of concrete and a decorative additive. Every layer has an interface with an adjacent layer to thereby form a plurality of interfaces wherein at least one, and preferably most or all, of the interfaces are non-level. Non-limiting examples of decorative additives are rocks, sea shells, colorants, and mixtures thereof. Methodology for fabricating the wall structure includes pouring a first concrete mixture into a substantially vertical form and permitting a top surface to assume a non-level configuration. Preferably, a joint forming material is placed on the top surface of this first concrete mixture to thereby form a first layer of the wall. In like manner, a second concrete mixture is poured on top of the first layer and a joint forming material is included. One or more additional layers as desired can be added in the same way to thereby complete physical formation of the wall, with the concrete mixtures preferably including decorative additives that are exteriorly visible. After form removal, the entire wall or individual layers thereof can be subjected to an exterior treatment such as etching, sand blasting, sponging, chipping, dusting on a color, applying a sealant, and combinations thereof.

19 Claims, 1 Drawing Sheet

Fig. 1
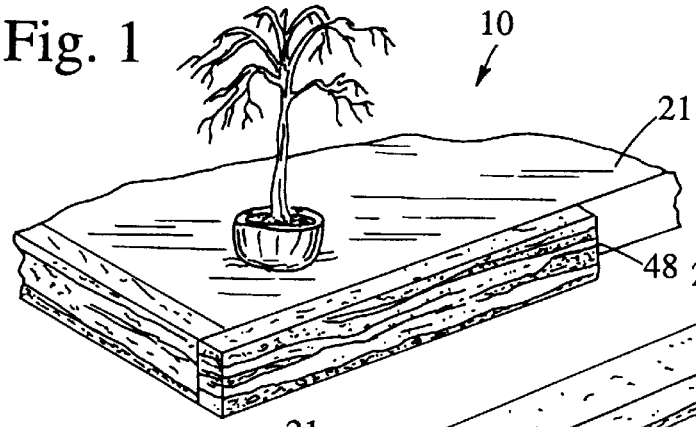
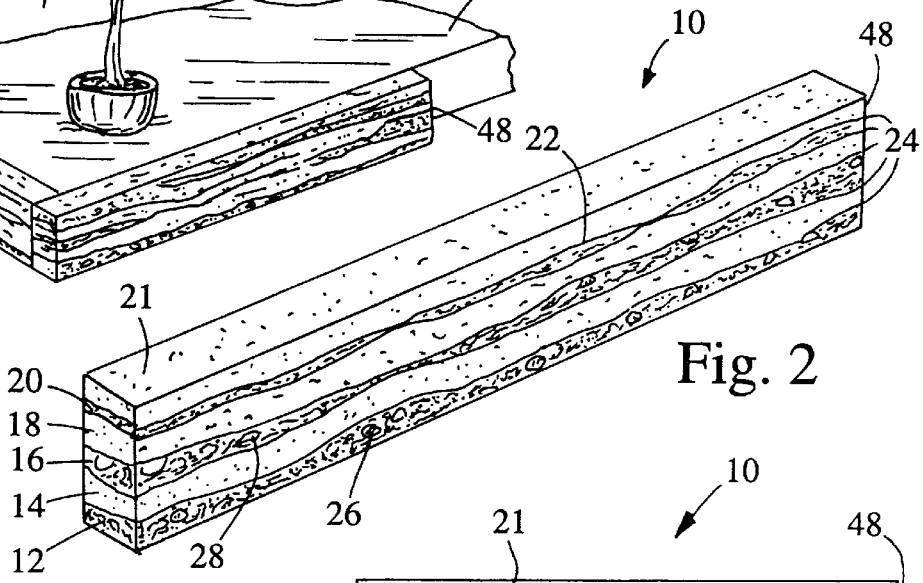
Fig. 2
Fig. 4
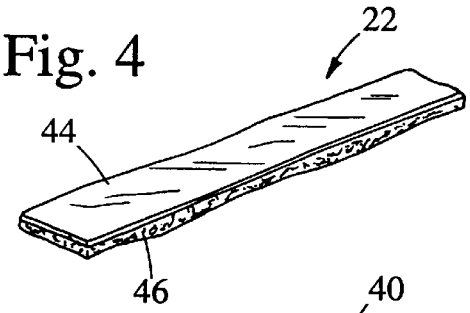
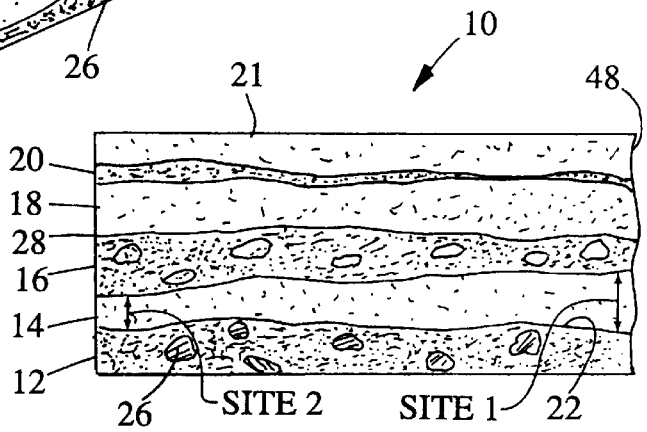
Fig. 3
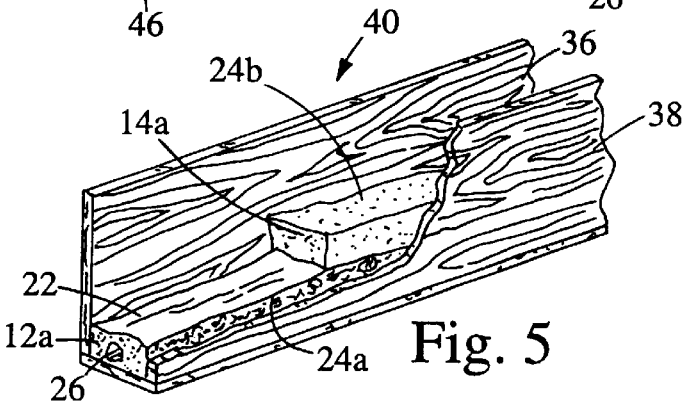
Fig. 5

DECORATIVE WALL AND METHOD OF FABRICATION

This application is a continuation of Ser. No. 08/906,286 filed Aug. 4, 1997 now U.S. Pat. No. 5,887,399.

FIELD OF THE INVENTION

The present invention relates in general to decorative walls such as for landscaping and the like, and in particular to a decorative wall having a plurality of discrete layers replicating a natural image to portray a naturally occurring wall structure.

BACKGROUND OF THE INVENTION

Many of the most desirable sights around the world are those formed by events caused over many years by the action of nature. Especially noteworthy are rock and stone wall formations created by centuries of erosion by water, by volcanic actions, or by other natural phenomena that expose a vertical face plane revealing a series of layers that represent respectively different mineral deposits, sedimentary accumulations, fossilized precipitates, and other naturally assembled matter. Evidence of the appeal of these natural attractions is apparent in the number of tourists who visit such places as the Rocky Mountains, Bryce canyon, and other similar destinations in the United States every year.

While the pleasure of these attractions is formidable, on-going enjoyment for most people when their respective visitations are over is generally limited to viewing photographs of these naturally layered wall-like structures. Thus, and although such walls are naturally available at only relatively few locations where actual residence generally is not even available, it is believed that a bona fide replication of the appearance of such walls at sites selected by respective viewers is desirous. Accordingly, a primary object of the present invention is to provide a formed wall structure whose exteriorly visible vertical plane has a plurality of layers situated to replicate natural appearance.

Another object of the present invention is to provide a formed wall structure with discrete layer separations.

Yet another object of the present invention is to provide a formed wall structure wherein the plurality of layers differ from each other in appearance and can include visible shells, rocks, colorant, or other materials.

These and other objects of the present invention will become apparent throughout the description thereof which now follows.

SUMMARY OF THE INVENTION

The present invention is a formed wall structure comprising a plurality of discrete layers and a method of fabricating this wall structure. Each of the layers of the structure comprises concrete, with at least one of such layers additionally comprising a decorative additive, and with each layer having an interface with an adjacent layer to thereby form a plurality of interfaces wherein at least one, and preferably most or all, of the plurality of interfaces are non-level. Non-limiting examples of decorative additives can be selected from the group consisting of rocks, sea shells, colorants, and mixtures thereof, while the exposed surface can be encompassed with a sealing material.

The present invention includes a method of fabricating a wall structure having a plurality of layers as defined above. The method comprises pouring a first quantity of a first concrete mixture into a substantially vertical form comprising two generally opposing walls and permitting a top surface of the first concrete mixture to assume a non-level configuration. Preferably, a joint forming material is placed on the top surface of this first concrete mixture to thereby form a first layer of the wall. In like manner, a second quantity of a second concrete mixture is poured on top of the first layer and permitted to assume a non-level configuration at its top surface. Once again, a joint forming material can be placed on the top to thereby complete formation of a second layer of the wall. One or more additional layers as desired can be added in the same way to thereby complete physical formation of the wall, with the concrete mixtures preferably including decorative additives that are exteriorly visible. The form is then removed, and the entire wall or one or more individual layers thereof can be subjected to an exterior treatment such as etching, sand blasting, sponging, chipping, dusting on a color, applying a sealant, and combinations thereof. In this manner, aesthetically appealing wall structures can be provided for placement and enjoyment at critical sites for architectural as well as artistic functionality.

BRIEF DESCRIPTION OF THE DRAWINGS

An illustrative and presently preferred embodiment of the invention is shown in the accompanying drawings in which:

FIG. 1 is a perspective view of a portion of a multi-layer decorative wall structure;

FIG. 2 is an enlarged perspective of the multi-layer decorative wall structure of FIG. 1;

FIG. 3 is a side elevation view of the wall structure of FIGS. 1 and 2;

FIG. 4 is a perspective view of joint a forming material for placement between layers; and FIG. 5 is a perspective view of a form within which a multi-layer decorative wall structure is built.

DETAILED DESCRIPTION OF THE PREFERRED EMBODIMENT

Referring to FIGS. 1–3, a multi-layer decorative wall structure 10 such as for outdoor architectural decor is shown. The structure 10 has five decorative layers 12, 14, 16, 18, 20, topped with a finishing layer 21, each preferably separated from its next adjacent layer(s) by respective cold joints 22 preferably formed as later described with fiber mats coupled with vapor barriers. As is apparent, the respective tops 24 of each layer 12, 14, 16, 18, 20 are not level to thereby better replicate a naturally occurring wall structure with respect to its formation as such natural formation occurred over centuries. Decorative additives non-limitedly exemplified by sea shells 26 and rocks 28 appear respectively in layers 12, 16 to be exteriorly visible. Additionally, dust-on colorant as known in the art can be applied to one or more layers in one or more colors or color shades to further replicate a naturally occurring wall formation. A sealing material 48 can be applied to encompass substantially all exposed surfaces of the wall structure. As illustrated in FIGS. 1–3, the vertical thickness of at least one layer varies along its length. Also, at least one layer generally sloping along its length such that one end of the at least one layer terminates at a vertical height below or above a terminal height of an opposite end of the layer.

Construction of the wall structure 10 is exemplified in FIG. 5 wherein two conventional, opposing, generally-parallel plywood boards 36, 38 are provided to build a form 40 as known in the art between which the wall structure 10 is formed. Construction commences by pouring a first quantity of a first concrete mixture 12*a* into the form 40 to a variable depth averaging about two inches, but preferably with a non-level top surface 24*a*. The concrete mixture includes concrete along with a decorative additive here shown as sea shells 26 as earlier described, and such mixture can be mixed prior to pouring or it can be formulated during the pouring step by adding the decorative additive to the concrete as it is being poured into the form 40. Preferably, a cold-joint forming material 22 comprising a vapor barrier such as a plastic sheeting or Visqueen® 44 and standard fiber matting 46 (FIG. 4) is placed on the top surface 24*a* to enhance appearance of resulting layers through cold-joint formation. The layer 12 thus formed is allowed to at least partially set such that addition of a second layer there above will not cause significant disturbance of the top surface 24*a*.

When appropriate, a second concrete mixture 14*a* is introduced into the form 40 on top of the first layer 12 as shown. As with the concrete mixture 12*a*, the mixture 14*a* includes concrete along with a decorative additive (e.g. a colorant as known in the art) as desired. Once again, the top surface 24*b* of the second concrete mixture 14*a* is permitted to assume a non-level configuration. Likewise as described above with respect to the first layer 12, a cold-joint forming material is positioned on the top surface 24*b* of the second concrete mixture 14*a* within the form 40. Thereafter, additional layers as desired can be formed as illustrated in FIG. 2 to thereby complete construction of the wall structure 10. If the wall structure 10 is to be used as a support for one or more items to be placed thereon as exemplified in FIG. 1, a flat cover piece 21, here shown as concrete, but which can be made of wood or other material, is formed over the structure 10 as shown. Construction of the wall structure 10 can be accomplished at the site of desired placement, or it can be constructed off-site in sections as required for size considerations and thereafter delivered to the location of ultimate placement.

As is apparent, the present invention provides a readily fabricated wall structure whose exteriorly visible vertical planes replicate the appearance of a naturally formed wall. While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A formed wall structure comprising a plurality of discrete layers each having a vertical thickness, with each layer comprising concrete and wherein at least one such layer additionally comprises a decorative additive, and further with each layer having an interface with an adjacent layer to thereby form a plurality of interfaces wherein at least one of said plurality of interfaces generally slopes along its length such that one end of said at least one interface terminates at a vertical height below or above a terminal vertical height of an opposite end of said interface.

2. A formed wall structure as claimed in claim 1 wherein each layer is visually different from an adjacent layer.

3. A formed wall structure as claimed in claim 2 wherein a majority of the plurality of interfaces are non-level.

4. A formed wall structure as claimed in claim 3 wherein the decorative additive is selected from the group consisting of rocks, sea shells, colorants, and mixtures thereof.

5. A formed wall structure as claimed in claim 4 comprising in addition a sealing material encompassing substantially all exposed surfaces of the wall structure.

6. A formed wall structure as claimed in claim 1 wherein a majority of the plurality of interfaces are non-level.

7. A formed wall structure as claimed in claim 1 wherein the decorative additive is selected from the group consisting of rocks, sea shells, colorant, and mixtures thereof.

8. A formed wall structure as claimed in claim 1 additionally comprising a joint forming material disposed between each layer.

9. A formed wall structure as claimed in claim 1 comprising in addition a sealing material encompassing substantially all exposed surfaces of the wall structure.

10. A method of fabricating a wall structure having a plurality of layers, the method comprising:

a) pouring a first quantity of a first concrete mixture into a substantially vertical form comprising two generally opposing walls and permitting a first top surface of the first concrete mixture to form;

b) pouring a second quantity of a second concrete mixture on top of the first layer and permitting a second top surface of the second concrete mixture to form;

c) pouring at least one additional quantity of at least one additional concrete mixture and permitting an additional top surface of the at least one additional concrete mixture to form, with the proviso that at least one of said top surfaces is generally sloping such that one end thereof terminates at a vertical height below or above a terminal vertical height of an opposite end of said at least one top surface; and d) removing the form.

11. A method of fabricating a wall structure having a plurality of layers, the method comprising:

a) pouring a first quantity of a first concrete mixture into a substantially vertical form comprising two generally opposing walls and permitting a first top surface of the first concrete mixture to form;

b) pouring a second quantity of a second concrete mixture directly on top of the first layer and permitting a second top surface of the second concrete mixture to form;

c) pouring as in step (b) at least one additional quantity of at least one additional concrete mixture and permitting an additional top surface of the at least one additional concrete mixture to form, with the proviso that at least one of said top surfaces is generally sloping such that one end thereof terminates at a vertical height below or above a terminal vertical height of an opposite end of said at least one top surface; and d) removing the form.

12. A method of fabricating a wall structure as claimed in claim 11 comprising in addition a surface treatment of an exterior surface of at least one layer of the wall.

13. A method of fabricating a wall structure as claimed in claim 12 wherein the surface treatment is selected from the group consisting of etching, sand blasting, sponging, chipping, dusting on a color, applying a sealant, and combinations thereof.

14. A method of fabricating a wall structure as claimed in claim 13 wherein each of the concrete mixtures comprises concrete and a decorative additive at least partially visible from an exterior site of the wall.

15. A method of fabricating a wall structure as claimed in claim 14 wherein the decorative additive is selected from the group consisting of rocks, sea shells, colorant, and mixtures thereof.

16. A method of fabricating a wall structure as claimed in claim 14 wherein the decorative additive is added to the concrete as said concrete is being poured into the form.

17. A method of fabricating a wall structure as claimed in claim 11 wherein each of the concrete mixtures comprises concrete and a decorative additive at least partially visible from an exterior site of the wail.

18. A method of fabricating a wall structure as claimed in claim 17 wherein the decorative additive is selected from the group consisting of rocks, sea shells, colorant, and mixtures thereof.

19. A method of fabricating a wall structure as claimed in claim 18 wherein the decorative additive is added to the concrete as said concrete is being poured into the form.

* * * * *